US006039817A

United States Patent [19]

Payne

[11] Patent Number: 6,039,817

[45] Date of Patent: Mar. 21, 2000

[54] EDGE AND SPOT CLEANING SYSTEM FOR VACUUM CLEANERS

[76] Inventor: Thomas S. Payne, 32205 Allison Dr., Union City, Calif. 94587

[21] Appl. No.: 09/107,247

[22] Filed: Jun. 30, 1998

[51] Int. Cl.[7] ..... A47L 9/02; B08B 5/04

[52] U.S. Cl. ..... 134/21; 15/331; 15/319; 15/416

[58] Field of Search ..... 15/416, 339, 331; 134/21

[56] References Cited

U.S. PATENT DOCUMENTS

| | | | |
|---|---|---|---|
| 1,782,882 | 11/1930 | Rippey | 15/416 X |
| 2,348,861 | 5/1944 | Smellie | 15/416 X |
| 3,936,903 | 2/1976 | Johnson | 15/416 X |
| 3,936,905 | 2/1976 | Stewart et al. | 15/416 |
| 3,942,216 | 3/1976 | Minton | 15/416 X |
| 3,942,219 | 3/1976 | Johnson | 15/416 X |
| 4,023,234 | 5/1977 | Martinec et al. | 15/416 X |
| 4,198,727 | 4/1980 | Farmer . | |
| 5,345,650 | 9/1994 | Downham et al. . | |
| 5,551,120 | 9/1996 | Cipolla et al. . | |

FOREIGN PATENT DOCUMENTS

| | | | |
|---|---|---|---|
| 1173623 | 7/1964 | Germany | 15/416 |

*Primary Examiner*—Chris K. Moore
*Attorney, Agent, or Firm*—Flehr Hohbach Test Albritton & Herbert LLP

[57] ABSTRACT

A vacuum cleaner (10) for cleaning edges and spots comprising a cleaning head (12) including a motor and fan assembly (14), a valve assembly (31), and a two-duct system (16) that includes a central duct (22) leading to a main inlet (29) and a pair of side ducts (24, 26) leading to a pair of edge cleaning fittings (28). Valve assembly (31) includes a valve mechanism that is selectively positionable to direct suction from one of the central duct and the side ducts, in order to perform regular vacuuming or edge or spot cleaning.

24 Claims, 13 Drawing Sheets

EDGE AND SPOT CLEANING SYSTEM FOR VACUUM CLEANERS

TECHNICAL FIELD

The present invention relates to vacuum cleaners and, more particularly, to vacuum cleaning heads and the design of their suction ducts and inlets and a method for constructing the same.

BACKGROUND OF THE INVENTION

Vacuum cleaners typically consist of a motor and a fan for creating suction, a vacuum bag housing for collecting dust and dirt, and a suction cleaning head, through which air is drawn by the fan to suck dirt and dust into the vacuum bag, as the cleaning head is swept across the floor or object to be cleaned. Cleaning heads usually have a wide yet relatively narrow suction area that spans laterally across a substantial portion of the width of the cleaning head, typically between 10 to 20 inches. Unfortunately, due to the central location of the fan, the strength of the suction diminishes near the sides of the suction area.

In addition, the suction area commonly includes a stationary or rotating brush that assists in dislodging dirt. The mounting apparatus at the ends of the rotating brush, which may include bearing assemblies, partially blocks the suction at the side edges of the cleaning head. Due to these factors, vacuum cleaners have difficulty cleaning corners and along floor edges near walls and in and around objects in a room. An object of this invention is to provide a mechanism for concentrating the suction of the vacuum near the edge of the vacuum cleaner to better clean near edges and corners. Another object is to concentrate the suction to better clean small soiled areas.

SUMMARY OF THE INVENTION

Briefly described, the cleaning head assembly for a vacuum cleaner of the present invention comprises a cleaning head including a main suction inlet that laterally spans a portion of the underside of the cleaning head, and at least one side suction inlet that is adjacent a side edge of the cleaning head, and a valve for selectively directing suction to either the main suction inlet or the side suction inlet. The vacuum cleaner provides for user control of the valve to selectively concentrate suction in one or more side suction inlets, preferably connected to a side duct and typically located in the corner of the vacuum cleaner head. By switching the valve, the operator can redirect suction from the main inlet to the edge cleaner fitting, concentrating the cleaning power of the vacuum on a corner edge or on a particularly dirty spot.

According to an aspect of the invention, the side inlets are laterally outward of the main inlet and each include a laterally outward facing opening directed to the side of the cleaning head in order to draw suction from the sides and pick up dirt positioned not directly under the side inlets. This enhances the cleaning action of the edge cleaning fittings, thus improving spot and edge cleaning.

According to another aspect of the invention, the valve selectively directs suction to one of a central duct leading to the main inlet and a side duct leading to the side inlet, to the exclusion of the other. Although the valve assembly can be designed to deliver suction to both the central duct and the side duct at the same time, and when spot or edge cleaning is desired, the valve assembly can be switched to direct suction solely to the side duct.

According to another aspect of the invention, the cleaning head includes an indicator for providing a signal that there is suction in the side ducts. Preferably, the indicator is responsive to suction in the side ducts and includes a pivotal plate position inside a window in the side duct. When there is suction in the side duct, the plate pivots to cover the window in a manner that signals the user that the valve assembly has switched. A second indicator can also be provided to signal that there is suction in the main inlet, with the second indicator as well being responsive to suction in the central duct.

According to another embodiment of the present invention, the vacuum cleaner includes a manifold for directing suction through the cleaning head from the main inlet and the side inlet, the manifold formed to direct through the side inlet a percentage of the total suction that is greater than the percent ratio of the area of the side inlet to the combined area of the main inlet plus the side inlet. In this embodiment, no valve assembly is included because suction is continuously directed to both the side duct and the central duct.

According to the method of the present invention, a surface area having a corner edge is cleaned by directing suction by means of a valve assembly from a suction generating device of the vacuum cleaner to a main suction inlet area that spans a portion of the underside of a cleaning head of the vacuum cleaner, to clean the surface away from the corner area, and by directing suction by means of the valve assembly to a side suction inlet area that is adjacent a side edge of the cleaning head, to clean the surface along the corner area.

According to an aspect of the method, suction is directed from underneath the cleaning head and also from at least one side of the cleaning head. Also, suction to the main suction inlet area is shut off when suction is directed to the side suction inlet area.

These and other features, objects, and advantages of the present invention will become apparent from the following description of the best mode for carrying out the invention, when read in conjunction with the accompanying drawings, and the claims, which are all incorporated herein as part of the disclosure of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
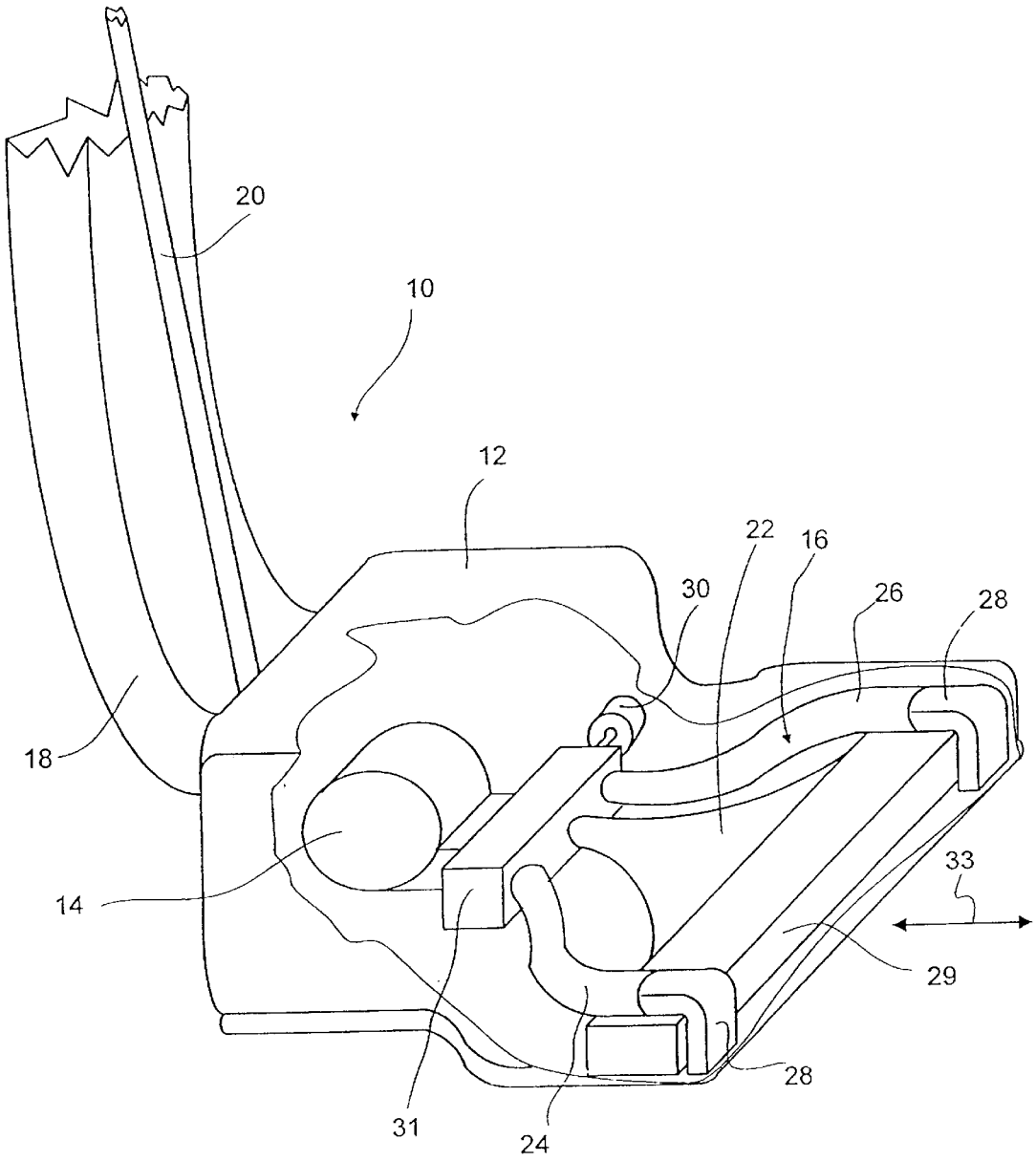
FIG. 1 is a cutaway view of the cleaning head of an upright vacuum cleaner embodiment of the present invention.

Referring to FIG. 1, vacuum cleaner 10 of the present invention includes a cleaning head 12, which houses a device that generates suction, such as a motor and fan assembly 14, and a duct system 16 leading from fan 14 to the underside of cleaning head 12. In the embodiment shown in FIG. 1, vacuum cleaner 10 is an upright model wherein cleaning head 12 supports the vacuum cleaner and during use is swept across the floor or object to be cleaned. Vacuum cleaner 10 also includes a dust and dirt receptacle 18 that houses a vacuum bag and which is supported on an adjustable arm 20, which is pivotally secured at the base of cleaning head 12 and at its upper end includes a handle (not shown) for controlling movement of the cleaning head. As used herein, the term "dirt" is meant to include all types of particles and substances commonly vacuumed from floors and carpeting, including dust particles and even liquids.

Duct system 16 includes a main central duct 22 and a pair of side ducts 24, 26. An edge cleaning fitting 28 is mounted at the end of each side duct 24, 26, for directing suction to the front corners of the cleaning head. A main suction inlet 29 is connected to central duct 22 and has sufficient length to laterally span a substantial area of the cleaning head so that movement of the cleaning head in forward and backward directions, indicated by arrows 33, moves main suction inlet 29 over a wide swath. Central duct 22 expands from its connection with a valve assembly 31 to its connection with main inlet 29. Side ducts 24, 26 may take the form of flexible tubing that is sealed at valve assembly 31 and at side inlets 28. Side ducts 24, 26 and edge cleaning fittings 28 create a duct system separate from that of central duct 22 so that there is no cross air flow between the central duct and the side ducts.

The valve assembly 31 is positioned between fan 14 and duct system 16 and, as discussed in more detail with reference to FIGS. 5(*a*)–(*c*), includes an internal slide valve (not shown) that is repositioned by a solenoid actuator 30. By operating a switch on the handle of the vacuum, the operator can set the position of the solenoid actuator 30, which opens or closes valve ports, redirecting suction from main suction inlet 29 to one or both of the edge cleaning fittings 28. In this respect, cleaning head 12 can be provided with just one side duct 24 or 26 and one corresponding edge cleaning fitting 28, but this arrangement would render vacuuming corners more difficult.

Figure 2:
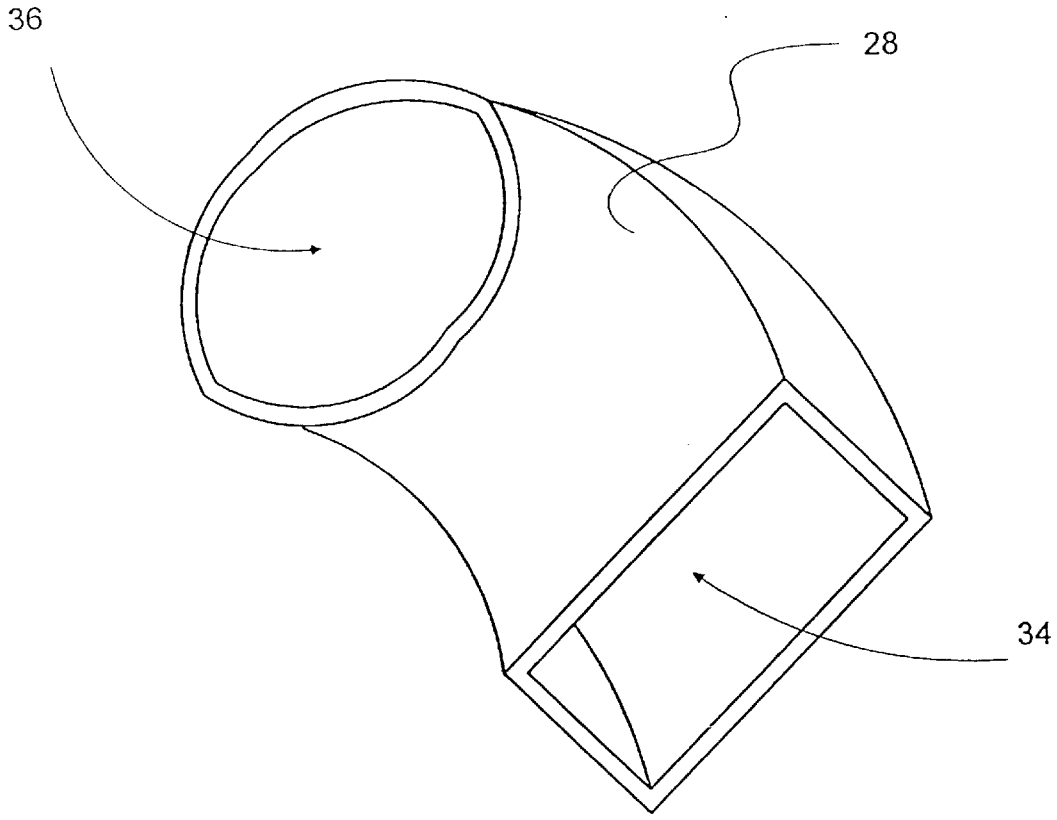
FIG. 2 is an edge cleaning fitting of the vacuum cleaner of FIG. 1.

Referring to FIG. 2, edge cleaning fitting 28 has an inlet opening 34, which when the fitting is properly mounted within the cleaning head, is generally directed downward toward the surface to be cleaned. Edge cleaning fitting 28 also includes an outlet opening 36 where it attaches to a side duct.

Figure 3A:
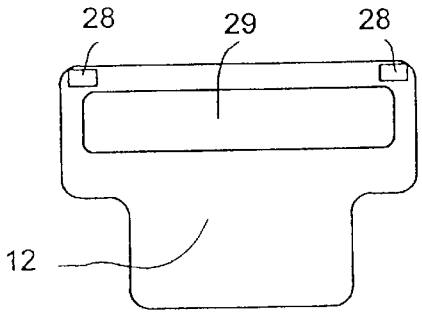
FIGS. 3(*a*)–3(*c*) are bottom views showing different locations for providing an edge suction fitting like that of FIG. 2.
Figure 3B:
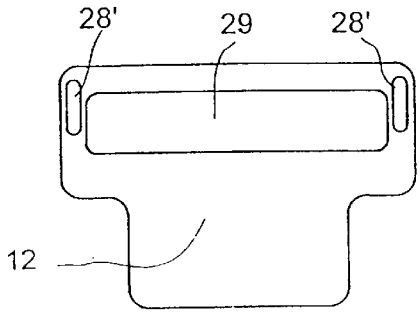
Figure 3C:
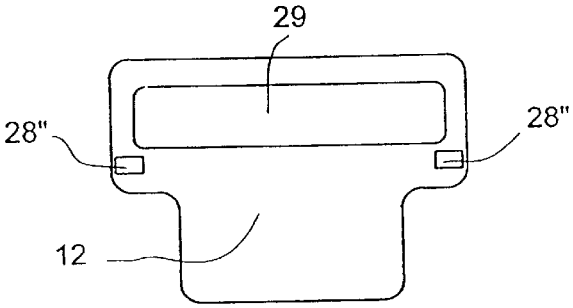

FIGS. 3(*a*)–(*c*) are bottom views of a vacuum cleaner head 12 showing different locations of edge cleaning fittings 28. In FIG. 3(*a*), edge cleaning fittings 28 are located adjacent the front corners of cleaning head 12. In this position, edge cleaning fittings 28 are positioned forward of main inlet 29 and laterally farther outward as well. With this design, fittings 28 are wider than they are long and thereby create a wider suction area than the designs of FIGS. 3(*b*) and 3(*c*). In FIG. 3(*b*), modified edge cleaning fittings 28' are elongated and narrow in shape and are positioned to the outside of main inlet 29. With this design, suction is more focused on the sides of the cleaning head. In FIG. 3(*c*), edge cleaning fittings 28" are repositioned to the back side of main inlet 29. This design is advantageous because it requires a simplified side duct system where the side ducts do not have to be routed over and around the central duct and main inlet.

Figure 4:
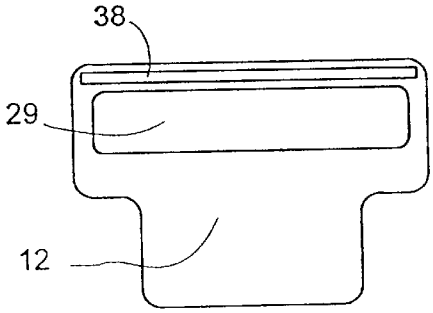
FIG. 4 is bottom view of a modified cleaning head with a front edge suction fitting.

FIG. 4 shows a cleaning head design that is slightly different than the designs of FIGS. 3(*a*)–(*c*). The cleaning head of FIG. 4 includes an elongated front edge suction slot 38 that spans a substantial portion of the width of cleaning head 12 and is positioned immediately adjacent the front edge of the cleaning head in front of main inlet 29. This design has the advantage of focusing suction along the front edge of the cleaning head, which enhances edge cleaning where the cleaning head is moved forward up against the edge of a wall for example.

Figure 5A:
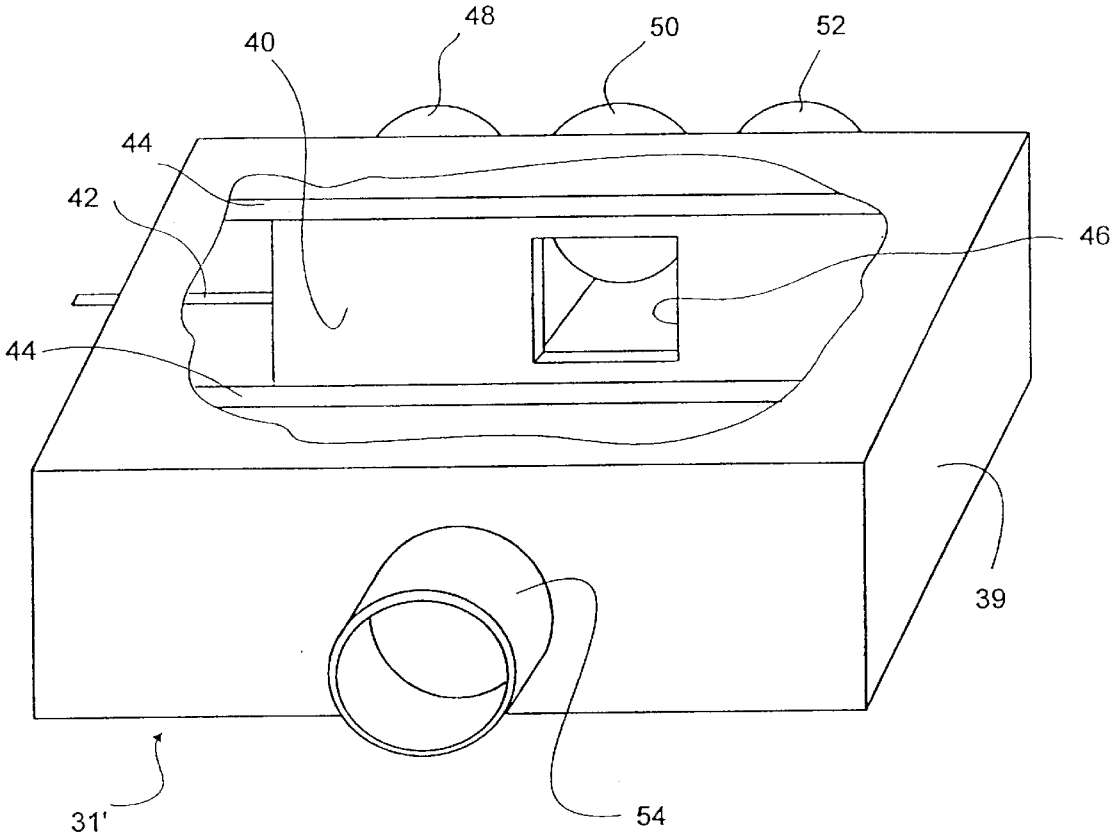
FIGS. 5(*a*)–(*c*) are pictorial views of different valve assemblies for the cleaning head of FIG. 1.
Figure 5B:
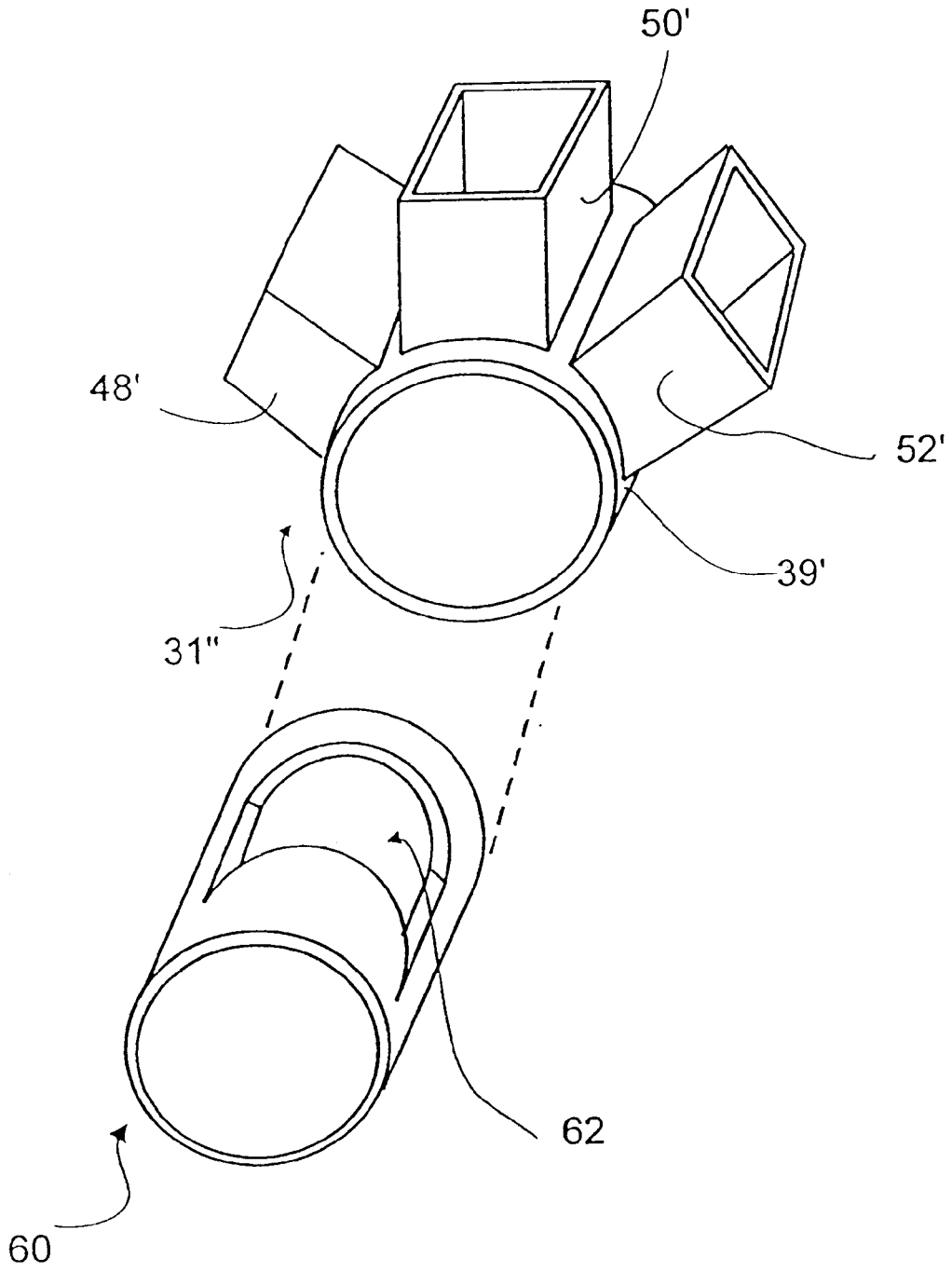
Figure 5C:
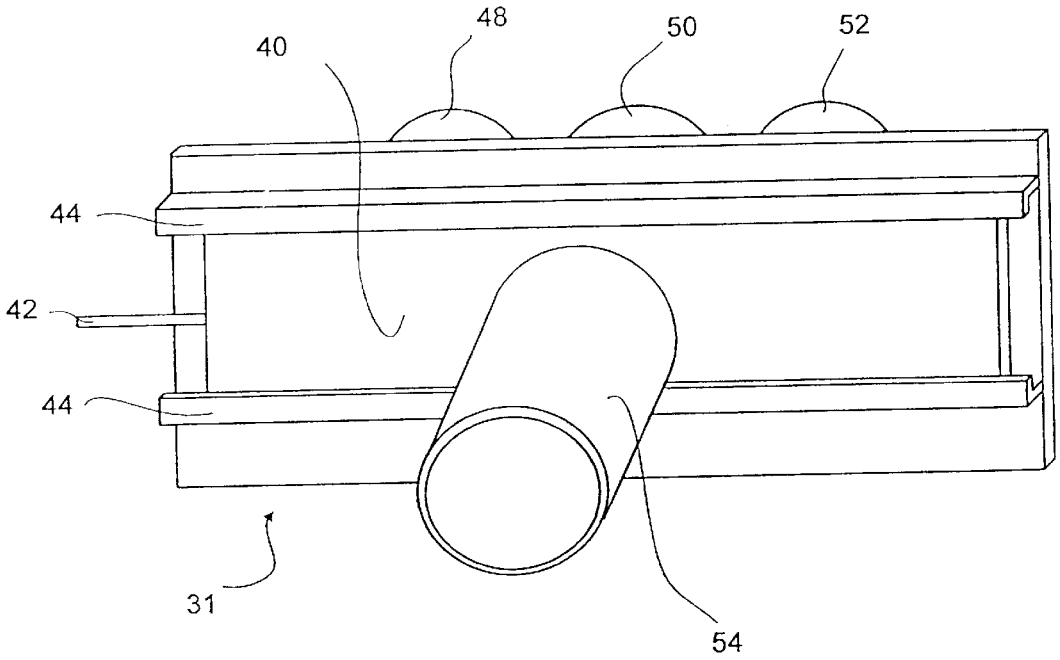

Referring to FIG. 5(*a*), valve assembly 31' includes a rectangular housing 39 that houses a sliding valve plate 40 whose sliding position is controlled by an actuator arm 42 that is connected to the solenoid actuator of the valve assembly. Valve plate 40 slides in upper and lower retainer tracks 44, which are secured within housing 39 and allow for lateral sliding movement of the valve plate. Valve plate 40 is a three-position valve and includes a center opening 46 that is selectively positioned in front of one of three suction input ducts 48, 50, 52. Input duct 48 connects with side duct 26 (FIG. 1), input duct 50 connects with central duct 22 and input duct 52 connects with side duct 24. The location of center opening 46 determines which duct suction is drawn through. The back side of valve assembly includes an outlet duct 54 that connects to the fan inlet. If the cleaning head is designed with a single side duct, then valve assembly 31' would need only a two-position valve plate, one for the central duct and one for the single side duct.

Other choices for valve assemblies are possible, different from that shown in FIG. 5(*a*). For example, in FIG. 5(*b*), a rotary valve assembly 31" includes a rotary spool 60 with an arcuate opening 62. Spool 60 fits within a cylindrical valve piece with three inlet ducts 48', 50' and 52', which correspond to the three inlet ducts of the valve assembly of FIG. 5(*a*). Not shown is a suitable rotary mechanism for rotating spool 60 to selectively direct suction from a desired inlet duct. FIG. 5(*c*) shows a modified version of the valve assembly of FIG. 5(*a*). With this embodiment, valve plate 40 is connected to outlet duct 54, yet still slides within rails 44 to selectively position outlet duct 54 into registry with one of the inlet ducts 48, 50, 52. A flexible hose would be required for connecting to outlet duct 54 in order to allow for lateral movement of the valve plate.

Alternatively, three separate valves could be used, each with its own actuator, one for each suction input duct. Also, a valve assembly could be built with two input ducts. In such a valve assembly, one duct could be attached to the central duct and the other to a single duct that is routed to both edge suction fittings. A mechanical lever or knob mechanism could be used in place of the switch and solenoid to actuate the valve. This mechanical lever or knob could be located as a hand control on the vacuum cleaner handle or on the cleaning head as a foot control. The valve slider could be replaced by a rotating disk or cylinder.

Figures 6, 7:
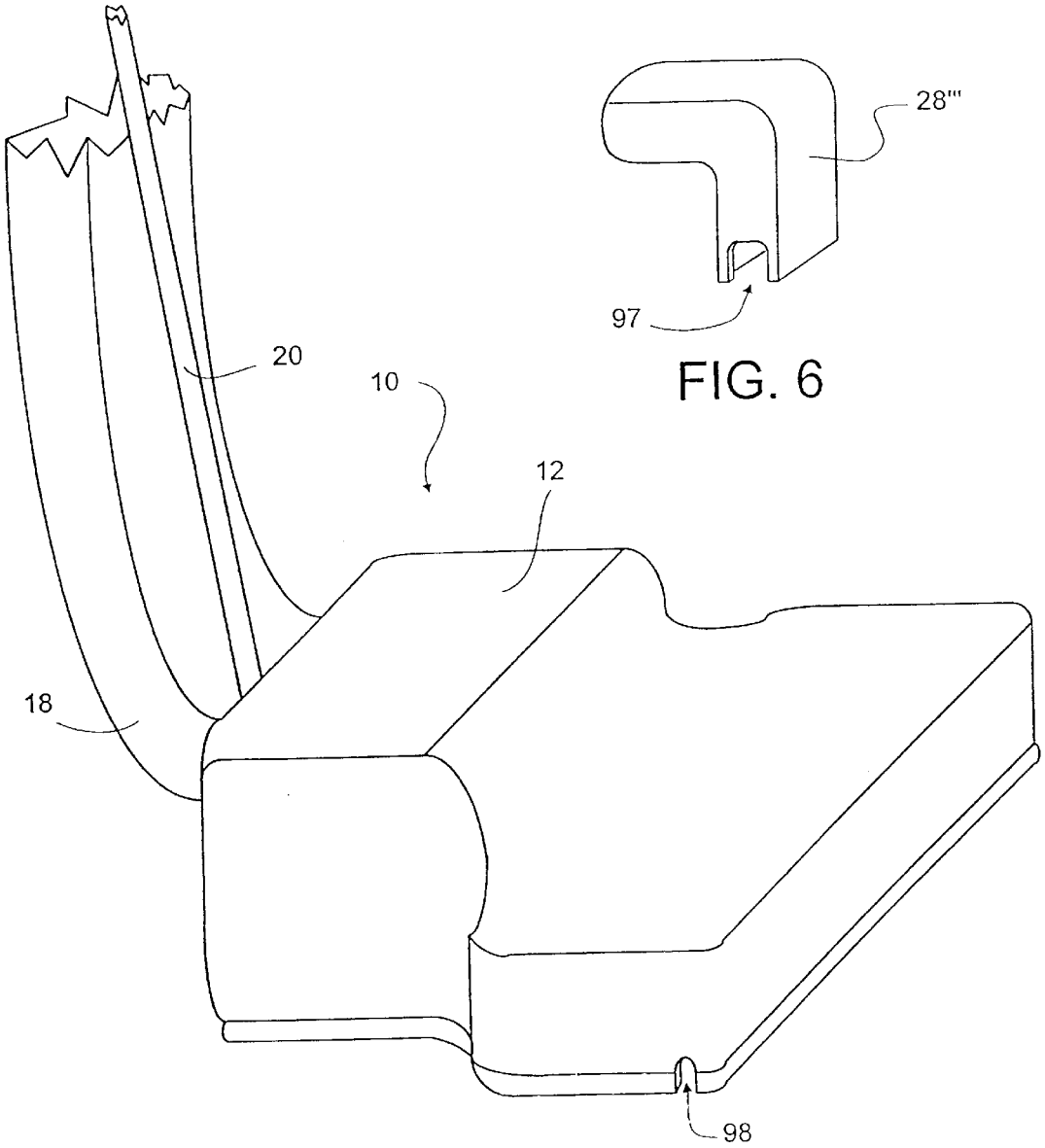
FIG. 6 is a pictorial view of an alternative embodiment of an edge cleaning fitting having an outwardly facing opening for drawing suction from the side of the cleaning head.
FIG. 7 is a pictorial view of an alternative embodiment of the cleaning head for use with the edge cleaning fitting of FIG. 6.

FIGS. 6 and 7 show an alternative embodiment for the edge cleaning fittings 28'''. In FIG. 6, fitting 28''' has a side, outwardly facing notch or opening 97 and, as shown in FIG. 7, the housing of cleaning head 12 includes a corresponding and aligned cut-out or notch 98. With this design, suction is directed from the sides of the cleaning head as well as from underneath, which enhances suction of dirt not directly underneath the inlet ducts. The embodiment of FIG. 4, which has a front edge fitting could also include similar forwardly facing notches that would direct suction from in front of the cleaning head.

The edge cleaning mechanism design shown in the foregoing figures is equally applicable to canister or central vacuum cleaning system. In a canister vacuum cleaner, a suction generator mechanism is located in a separate portable unit that is attached via a hose to a modified vacuum cleaning head. In a central vacuum cleaning system, the suction generation mechanism is located at a fixed location within a building and ducts are provided that lead to suction outlets, typically in a floor or wall, which allow a suction hose to connect to the vacuum system. A portable vacuum cleaning head is joined with the suction hose and connected to one of the suction outlets adjacent the area to be cleaned.

Figure 8:
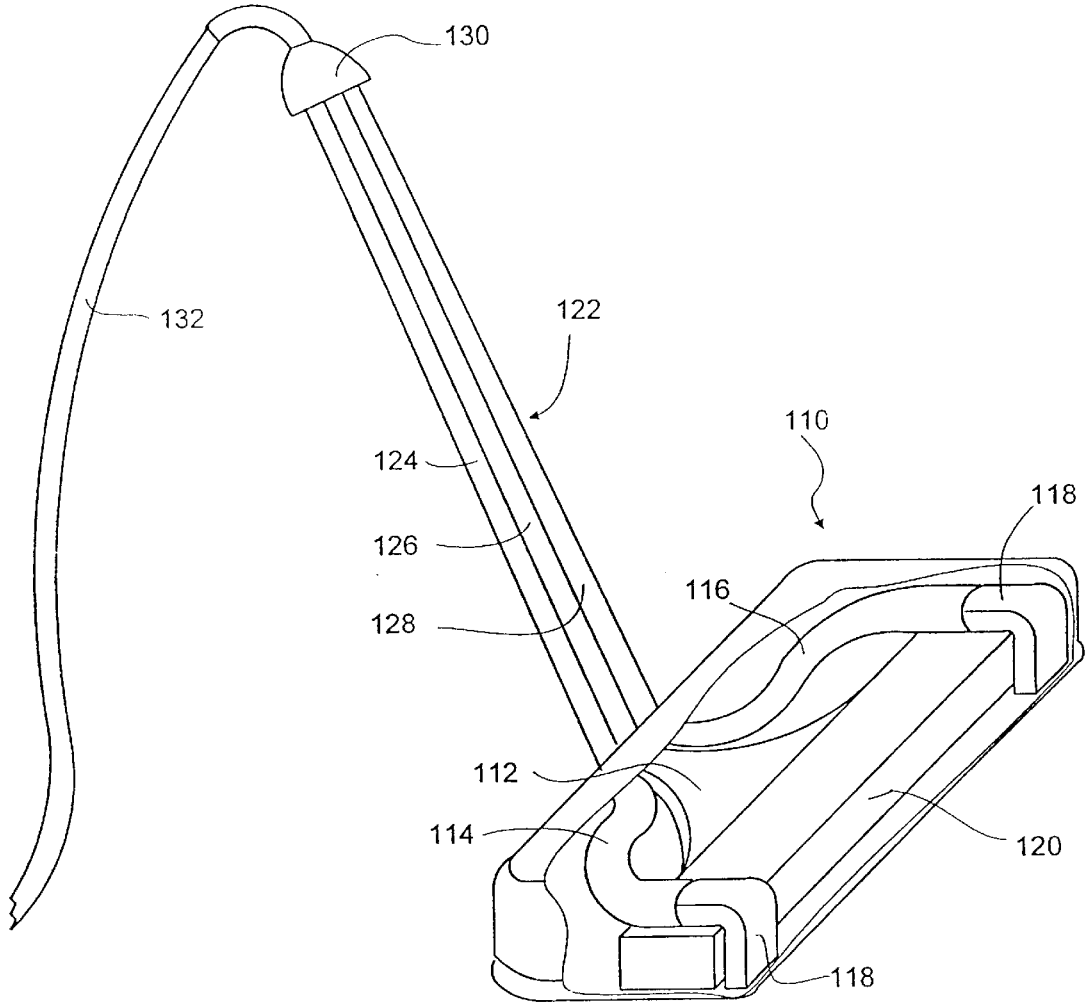
FIG. 8 is a cut-away view of a second cleaning head embodiment of a canister or a central vacuum system.

Referring to FIG. 8, for both a canister vacuum and a central system, a modified vacuum cleaning head 110 can be used that does not include a motor and fan assembly, but does include a main duct 112 and a pair of side ducts 114, 116, a pair of edge cleaning fittings 118, and a main inlet 120. An upright and pivotal handle 122 includes a set of three suction tubes for connecting with side ducts 114, 116 and central duct 112. Suction tube 124 connects with side duct 114, suction tube 126 connects with central duct 112, and suction tube 128 connects with side duct 116. A handle valve 130 includes a switch (not shown) for directing suction from a suction hose 132 to either the main suction area on inlet 120 or to one of the edge cleaning fittings 118.

Figure 9:
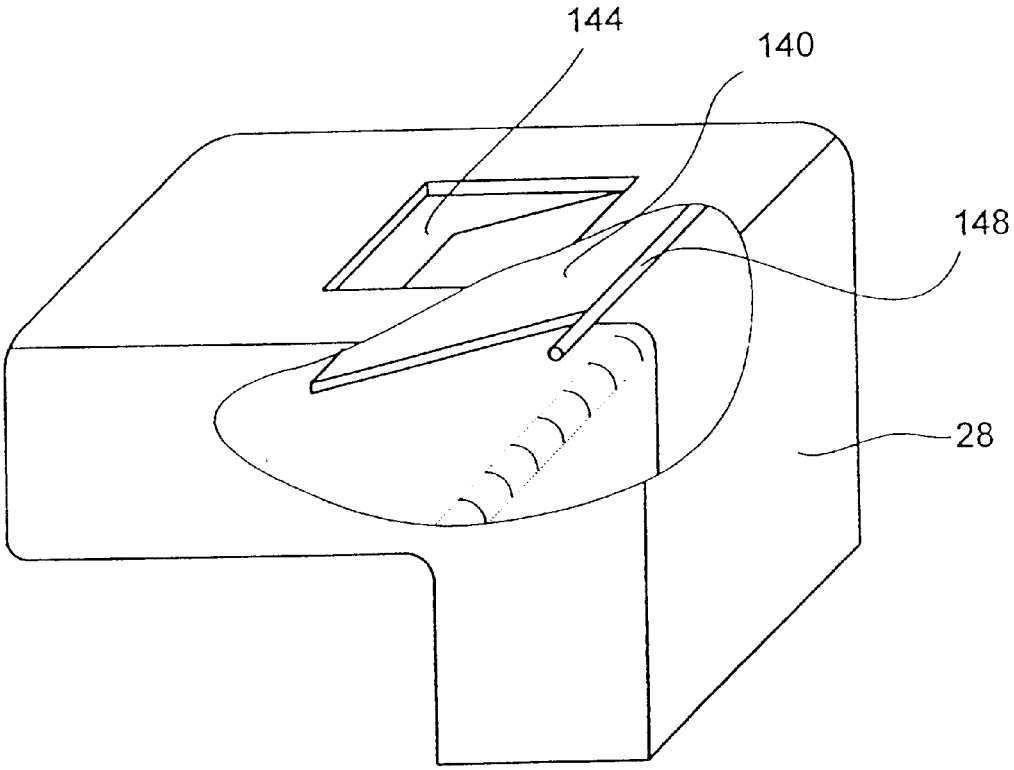
FIG. 9 is a cut-away view of a suction direction indicator mechanism within the edge cleaner fitting of FIG. 2.
Figure 10:
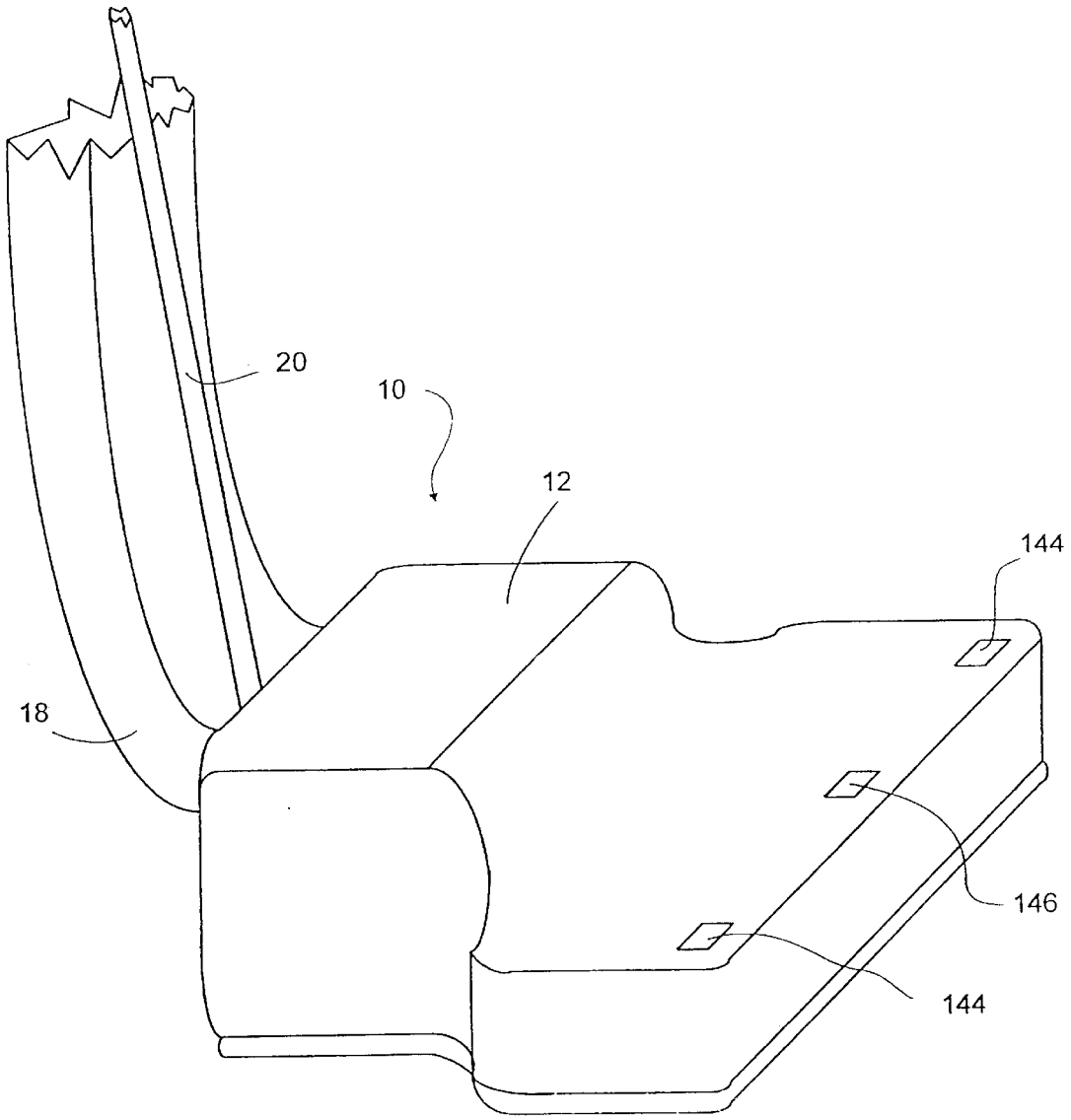
FIG. 10 is a pictorial view of the cleaning head of FIG. 1 showing the location of suction direction indicators of FIG. 9.

Referring to FIG. 9, edge cleaning fitting 28, as well as any of the other edge cleaning fittings shown in FIGS. 3(*a*)–(*c*) and also the main inlet as well, can include an indicator for signaling to the operator where the suction is currently directed. Preferably, the indicator is a suction activated indicator that includes a pivotal or otherwise movable indicator plate 140 that pivots on a pin 142 secured within fitting 28. A see-through window 144 is provided in the top of fitting 28. Window 144 is slightly smaller in size than plate 140. When there is suction in fitting 28, airflow causes indicator plate 140 to pivot upward becoming visible in window 144. In this manner, indicator plate 140 is responsive to suction in the side ducts. Indicator plate 140 preferably is brightly colored to maximize visibility. Alternatively, the indicator can be part of the switch used to activate the valve or a mechanical indicator attached to the valve actuator. FIG. 10 shows where the indicator windows 140 are located on the vacuum cleaning head 12. Also shown is an indicator window 146 that is part of the main inlet fitting attached to the central duct.

Figure 11:
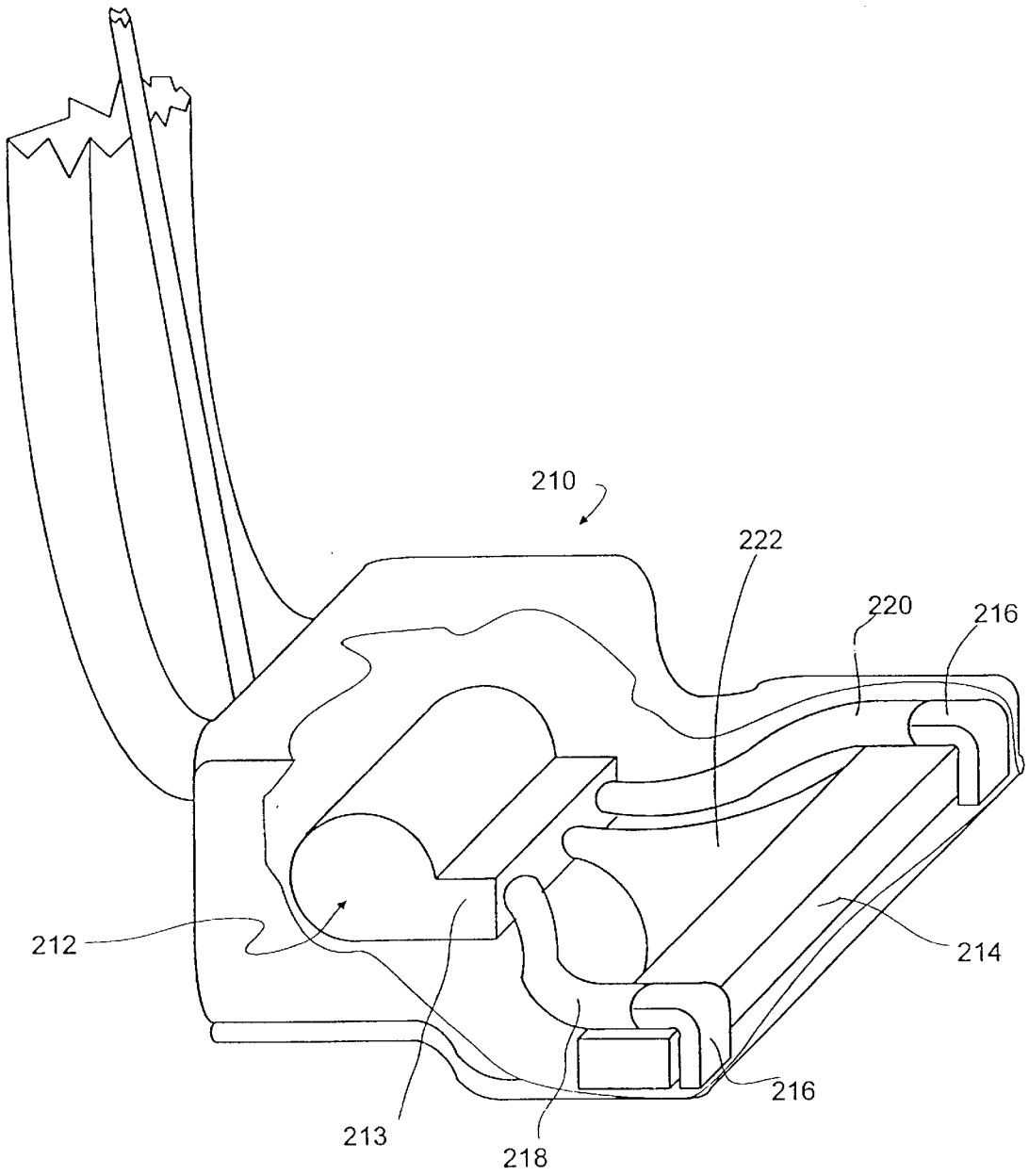
FIG. 11 is a cutaway view of a third cleaning head embodiment having edge cleaner fittings, separate ducts and a high intensity suction system.

Referring to FIG. 11, another alternative embodiment of a cleaning head 210 has a stronger motor and fan assembly 212 and integral manifold chamber 213 that includes internal manifolding to direct suction through the side inlet, and also includes a main suction inlet 214 and edge cleaning fittings 216. Similar side ducts 218, 220 and central duct 222 are provided to create separate ducting between fan assembly 212 and the suction inlets of the cleaning head. In this embodiment, ducts 218, 220, and 222 connect directly with the fan assembly and no switching valve is provided. When in operation, the suction is continuously present at both the main suction inlet and at the edge cleaning fittings. Alternatively, multiple suction devices could be used in place of the stronger suction device.

The manifold chamber is formed to direct through the side inlet a percentage of the total suction that is greater than the percent ratio of the area of the side inlet to the combined area of the main inlet plus the side inlet. For example, if the inlet area of the edge fittings is ¼ that of the main inlet, then the side inlet or edge fitting inlet area is ⅕ the total combined inlet area of the edge fittings and main inlet. The manifold should be configured to direct more than 20% of the total suction through the side inlets and edge fittings, and preferably, for this example, at least 30–40% of the suction through the side inlets.

When suction is directed to a side duct or front edge duct in the embodiments of FIGS. 1–10, it is preferable to turn off the rotary brush in the main inlet and for this, the wiring for the rotary brush could include a switch that is opened when the solenoid actuator of the valve assembly is engaged to move the valve plate into registry with a side duct.

Figure 12:
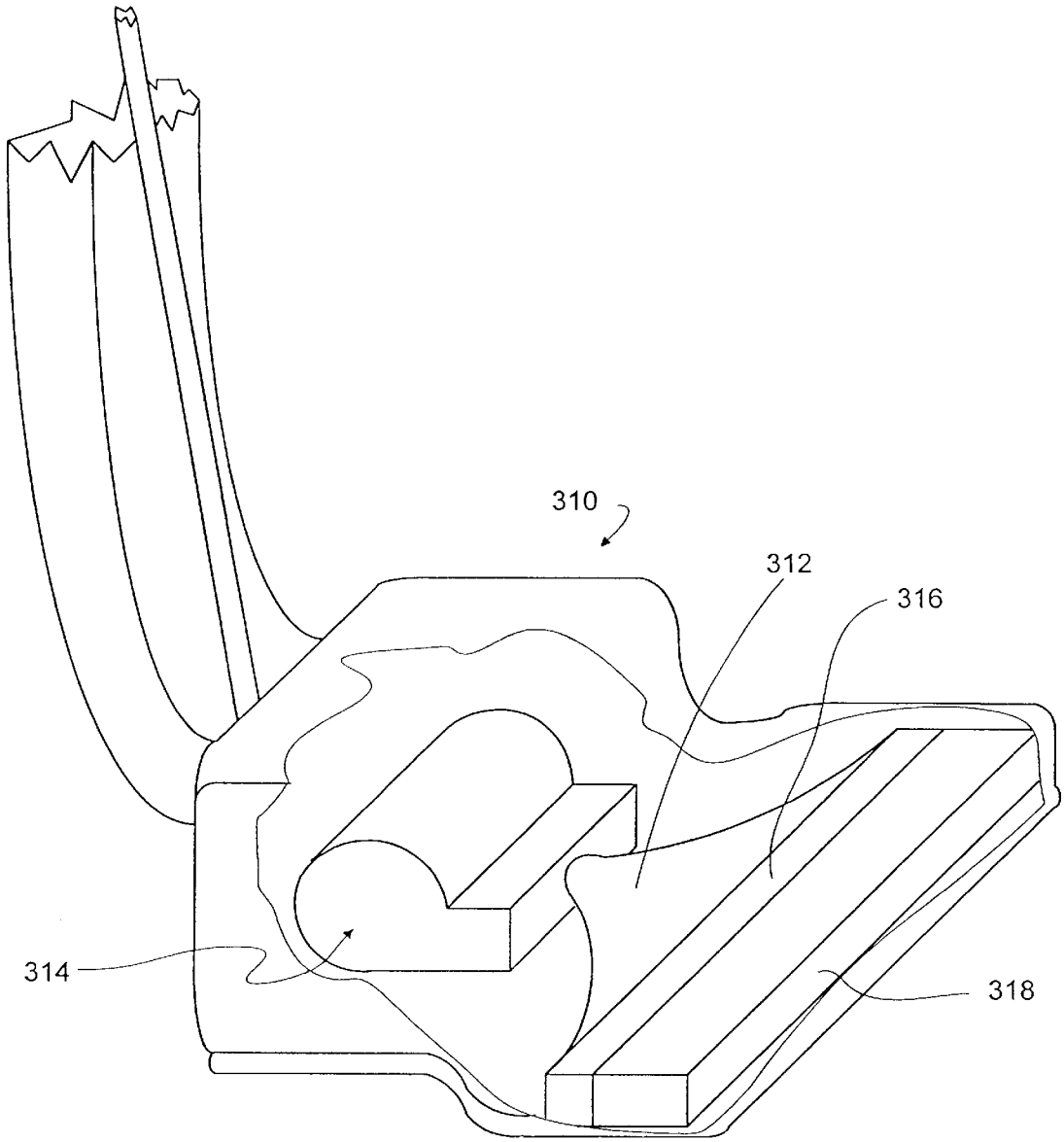
FIG. 12 is a cut-away view of a fourth cleaning head embodiment having a single duct suction system.
Figure 13:
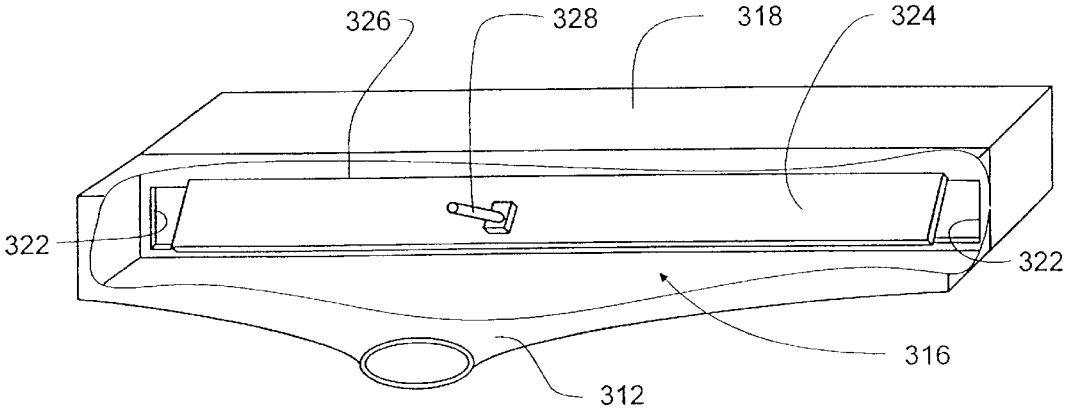
FIG. 13 is a cut-away pictorial view of the valve mechanism and suction inlet area of the cleaning head of FIG. 12.

FIGS. 12 and 13 illustrate a fourth embodiment for a cleaning head 310 of the present invention. Cleaning head 310 differs from the other embodiments because it has only a single duct 312 leading from a suction generation device 314 and leading to an elongated valve mechanism 316 that controls suction to an elongated suction inlet chamber 318. Suction inlet chamber spans the width of cleaning head 310, as does valve mechanism 316, and is positioned at the forward edge of the cleaning head to enhance cleaning of corner areas.

A single duct system is made possible by the design of valve mechanism 316, which is best shown in FIG. 13. Valve mechanism 316 includes an elongated slot opening 322 at its forward side adjacent suction inlet chamber 318. Slot opening 318 provides for fluid communication between suction inlet chamber 318 and duct 312. An elongated, but slightly shorter damper valve 324 is mounted within valve mechanism 316 to pivot along its upper edge 326 and is movable between open and closed positions by means of an actuator rod 328 connector to a suitable actuator (not shown).

Damper valve 324 pivots from a closed position where all but the outer portions of slot opening 322 are blocked, or closed off, which redirects suction to the outer regions of suction inlet chamber 318. This has the effect of focusing and enhancing suction at the outer sides of inlet chamber 318, which achieves similar results to the dual duct design of earlier embodiments. The outer regions of inlet chamber, when damper valve 324 is closed, become in effect the side suction inlet areas, while the central region of inlet chamber 318 becomes the main suction inlet area.

The idea of the single duct system of FIGS. 12 and 13 is to create greater suction at the outer side regions of the cleaning head by means of a valve mechanism or other similar device that is positioned in the path of suction from the main suction inlet. While the dual duct system of FIGS. 1–11 is preferable because suction at the side inlets is more concentrated and isolated, a single duct system works satisfactorily and may be less expensive to manufacture.

From the foregoing it can be seen that the present invention also comprises a method of cleaning a surface area that includes the following steps: (1) directing suction by means of a valve assembly from a suction generating device of the vacuum cleaner to a main suction inlet area that spans a portion of the underside of a cleaning head of the vacuum cleaner, to clean the surface away from the corner area, and (2) directing suction by means of the valve assembly to a side suction inlet area that is adjacent a side edge of the cleaning head, to clean the surface along the corner area.

In the method of the present invention, suction is preferably directed from underneath the cleaning head and also from the side of the cleaning head. Also preferably, suction to the main suction inlet area is shut off when suction is directed to the side suction inlet area.

The method of the present invention can be practiced by directing suction from a valve assembly to the main suction inlet area by a first central duct and to the side suction inlet area by a side duct. Alternatively, the method can be practiced by directing suction to both the main suction inlet area and the side suction inlet area by a common duct, and suction is directed to the side suction inlet area by closing off the main suction inlet area.

While the method and apparatus of the present invention can include only a single side suction inlet, in addition to the main suction inlet, preferably a pair of side suction inlet areas are provided, one on each side of the main suction inlet area so that suction can be controlled at both sides of the cleaning head.

The present invention also includes a method of constructing a vacuum cleaner comprising the steps of: (1) coupling a cleaning head assembly in fluid communication with a suction generating assembly, the cleaning head assembly having a main suction inlet extending there across and a side suction inlet positioned proximate the main suction inlet and a side of the cleaning head assembly, and (2) mounting a suction directing valve assembly between the suction generating assembly and the main suction inlet and the side suction inlet, the valve assembly adapted to selectively control the amount of suction communicated to at least one of the main suction inlet and the side suction inlet.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application various embodiments with various modifications as are suited to the particular use contemplated. It is intended that the scope of the invention be defined by the claims appended hereto when read and interpreted according to accepted legal principles such as the doctrine of equivalents and reversal of parts.

What is claimed is:

1. A cleaning head assembly for a vacuum cleaner, comprising, a cleaning head including a main suction inlet area that laterally spans a portion of the underside of the cleaning head, and at least one side suction inlet area that is adjacent a side edge of the cleaning head, a valve for selectively directing suction to at least one of the main suction inlet and the side suction inlet and an indicator for providing a signal that there is suction in the side ducts, the indicator being responsive to suction in the side ducts.

2. The cleaning head assembly of claim 1 wherein, the cleaning head includes a second side suction inlet on the side of the cleaning head opposite the first side inlet.

3. The cleaning head assembly of claim 2 wherein, the side inlets each include a laterally outward facing opening directed to the side of the cleaning head in order to draw suction from the sides and pick up dirt positioned not directly under the side inlets.

4. The cleaning head assembly of claim 1 and further comprising, a first duct leading from the valve to the main suction inlet area and a side duct leading from the valve to the side suction inlet area.

5. The cleaning head assembly of claim 4 wherein, the valve selectively directs suction to one of the first duct and the side duct to the exclusion of the other.

6. The cleaning head assembly of claim 5 wherein, the first duct is separate from the side duct so that there is no cross air flow between the two.

7. The cleaning head assembly of claim 6 wherein, the first duct and side duct are separate ducts from the valve to the inlets.

8. The cleaning head assembly of claim 6 wherein, the side duct includes tubing leading from the valve to the side inlet, which tubing segregates the air flow in the side duct from the air flow in the first duct.

9. The cleaning head assembly of claim 1 and further comprising, a second indicator for providing a signal that there is suction in the main suction inlet area, the second indicator being responsive to suction in the first duct.

10. A vacuum cleaner comprising, a cleaning head including a first central duct leading to a main inlet that laterally spans a substantial portion of the underside of the cleaning head, and at least one side duct leading to a side inlet of the cleaning head that is adjacent a side edge of the cleaning head, a manifold for directing suction through the cleaning head from the main inlet and the side inlet, the manifold formed to direct through the side inlet a percentage of the total suction that is greater than the percent ratio of the area of the side inlet to the combined area of the main inlet plus the side inlet, a suction generating assembly for drawing suction through the cleaning head and manifold and an indicator for providing a signal that there is suction in the side duct, the indicator being responsive to suction in the side duct.

11. The vacuum cleaner of claim 10 wherein, the manifold directs through the side inlet a percentage of the total suction that is at least twice as great as the percent ratio of the area of the side inlet to the combined area of the main inlet plus the side inlet.

12. The vacuum cleaner of claim 10 wherein, wherein the suction generating assembly includes a motor and fan coupled to the manifold for drawing suction through the central duct and side duct.

13. The vacuum cleaner of claim 10 wherein, the cleaning head includes a second side duct that leads to a side inlet on the side of the cleaning head opposite the first side inlet.

14. The vacuum cleaner of claim 13 wherein, the side inlets are laterally outward of the main inlet.

15. The vacuum cleaner of claim 14 wherein, the side inlets each include a laterally outward facing opening directed to the side of the cleaning head in order to draw suction from the sides and pick up dirt positioned not directly under the side inlets.

16. The vacuum cleaner of claim 10 wherein, the main duct is separate from the side duct so that there is no cross air flow between the two.

17. The vacuum cleaner of claim 16 wherein, the main duct and side duct are separate ducts from the valve to the inlets.

18. A method of cleaning a surface having a corner area with a vacuum cleaner, comprising the steps of:

(1) directing suction by means of a valve assembly from a suction generating device of the vacuum cleaner to a main suction inlet area that spans a portion of the underside of a cleaning head of the vacuum cleaner, to clean the surface away from the corner area, (2) directing suction by means of the valve assembly to a side suction inlet area that is adjacent a side edge of the cleaning head, to clean the surface along the corner area and (3) providing an indicator to signal that there is suction in the side suction inlet area.

19. The method of claim 18 wherein step (2) of claim 18 includes directing suction from underneath the cleaning head and also from the side of the cleaning head.

20. The method of claim 18 wherein suction to the main suction inlet area is shut off when suction is directed to the side suction inlet area.

21. The method of claim 18 wherein suction is directed from a valve assembly to the main suction inlet area by a first central duct and to the side suction inlet area by a side duct.

22. The method of claim 18 wherein suction is directed to both the main suction inlet area and the side suction inlet area by a common duct, and suction is directed to the side suction inlet area by closing off the main suction inlet area.

23. The method of claim 18 and further comprising directing suction to a second side suction inlet area that is on an opposite side of the main suction inlet area from the first side suction inlet area.

24. The method of claim 23 wherein the first and second side suction inlet areas are adjacent opposite sides of the cleaning head.

* * * * *